US009073380B2

(12) United States Patent
Lee

(10) Patent No.: US 9,073,380 B2
(45) Date of Patent: Jul. 7, 2015

(54) WRITING INSTRUMENT WITH A MOVABLE ORNAMENT MOUNTED THEREON

(71) Applicant: Pao-Feng Lee, Taipei (TW)

(72) Inventor: Pao-Feng Lee, Taipei (TW)

( * ) Notice: Subject to any disclaimer, the term of this patent is extended or adjusted under 35 U.S.C. 154(b) by 203 days.

(21) Appl. No.: 13/916,604

(22) Filed: Jun. 13, 2013

(65) Prior Publication Data

US 2013/0272772 A1 Oct. 17, 2013

Related U.S. Application Data

(63) Continuation-in-part of application No. 12/461,629, filed on Aug. 19, 2009, now Pat. No. 8,182,165.

(51) Int. Cl.

| | |
|---|---|
| ***B43K 29/00*** | (2006.01) |
| ***G09F 19/06*** | (2006.01) |
| ***G09F 19/08*** | (2006.01) |

(52) U.S. Cl.

CPC ..... *B43K 29/00* (2013.01); *G09F 19/08* (2013.01); *G09F 19/06* (2013.01)

(58) Field of Classification Search

USPC ..... 401/195

See application file for complete search history.

(56) References Cited

U.S. PATENT DOCUMENTS 8,182,165 B2 * 5/2012 Lee ..... 401/117

* cited by examiner

*Primary Examiner* — David Walczak
*Assistant Examiner* — Joshua Wiljanen

(57) ABSTRACT

An amusement writing instrument with a mechanical toy consists of an elongated pen body having a seat mounted on an end, a toy housing said seat and a working piece passing through said seat. The working piece comprises of a rod, pluralities of driving elements driven by the rod and pluralities of resilient devices for providing reciprocal movement. The ornament composes of a frontal and rear casings and a decorating object is further attached to the seat. The working piece is driven as the user propels the cartridge to disengage the frontal casings from the rear casing, creating a slit for allowing the decorating object to be extended and exposed.

10 Claims, 9 Drawing Sheets

WRITING INSTRUMENT WITH A MOVABLE ORNAMENT MOUNTED THEREON

This application is a Continuation-In-Part of U.S. Pat. No. 8,182,165 B2, filed on Aug. 19, 2009, and patented on May 22, 2012.

FIELD OF THE INVENTION

Background of the Invention

Writing instrument, such as pen or pencil usually has a toy or an ornament mounted on the top for increasing the beauty or providing appearance changing. The ornament is a symbol of fashion as it usually represents the preference of a user or the society. An integral molded figure of animal, famous cartoon characters or other objects are often mounted on a pen, chopsticks or others rod-like objects for attracting sight of others. The ornament often incorporates movable components which can be actuated as the retractable cartridge is operated as claimed in the cited references 1 and 2. The cited reference 1, designated with the publication number TW 264762, entitled "Pen with Funny Ornament" discloses two symmetrical casings, a gear set, a spherical compartment and a mechanical device for actuating said retractable cartridge. The mechanical toy is provided within said spherical compartment and is actuated by a magnet incorporated in said gear set. The cited reference 2, designated with the publication number TW M294429, entitled "Pen with Funny Ornament" discloses a seat, a slide, a spear-like plate and a rod-like decoration. The plate is engaged with said slide and said plate triggers the decoration to perform swing movement as cartridge or lead of the pen moves is propelled or retracted. However, such monotonic decoration and simple movement bores the user easily as it lacks change of the shape of the ornament. Therefore, to provide an ornament with movable part which can drive the reaction of the object coupled with for increasing its amusing factor has become the objective of the present invention.

SUMMARY OF THE INVENTION

To achieve foregoing objectives, the present invention relates to a mechanical pen which incorporates a retractable cartridge with a mechanical toy or ornament mounted thereon and the toy is driven in response to the action of the cartridge. The present invention can be realized in two embodiments. In the first embodiment, a toy comprises of a frontal and rear casings coupling each other for housing a seat and a decorating object. The object is attached to the seat which is connected to the mechanical device for propelling and retracting the cartridge. The upper portion of the decorating object engages to a frame for securing the object as is concealed within the casings. As the cartridge is extended, both frontal and rear casings are separated and the decorating object is driven to be exposed therefrom.

In the second embodiment, the toy comprises of same mechanical structure as disclosed in the first embodiment. However, the monopiece frontal and rear casings are now formed by assembling two inner casings and outer casings. Said inner casings house the mechanical components of the toy and said outer casings can engage the inner casings and are exchangeable to add creativity and fun factor for the toy.

DETAIL DESCRIPTION OF PREFERRED EMBODIMENTS

Figure 1:
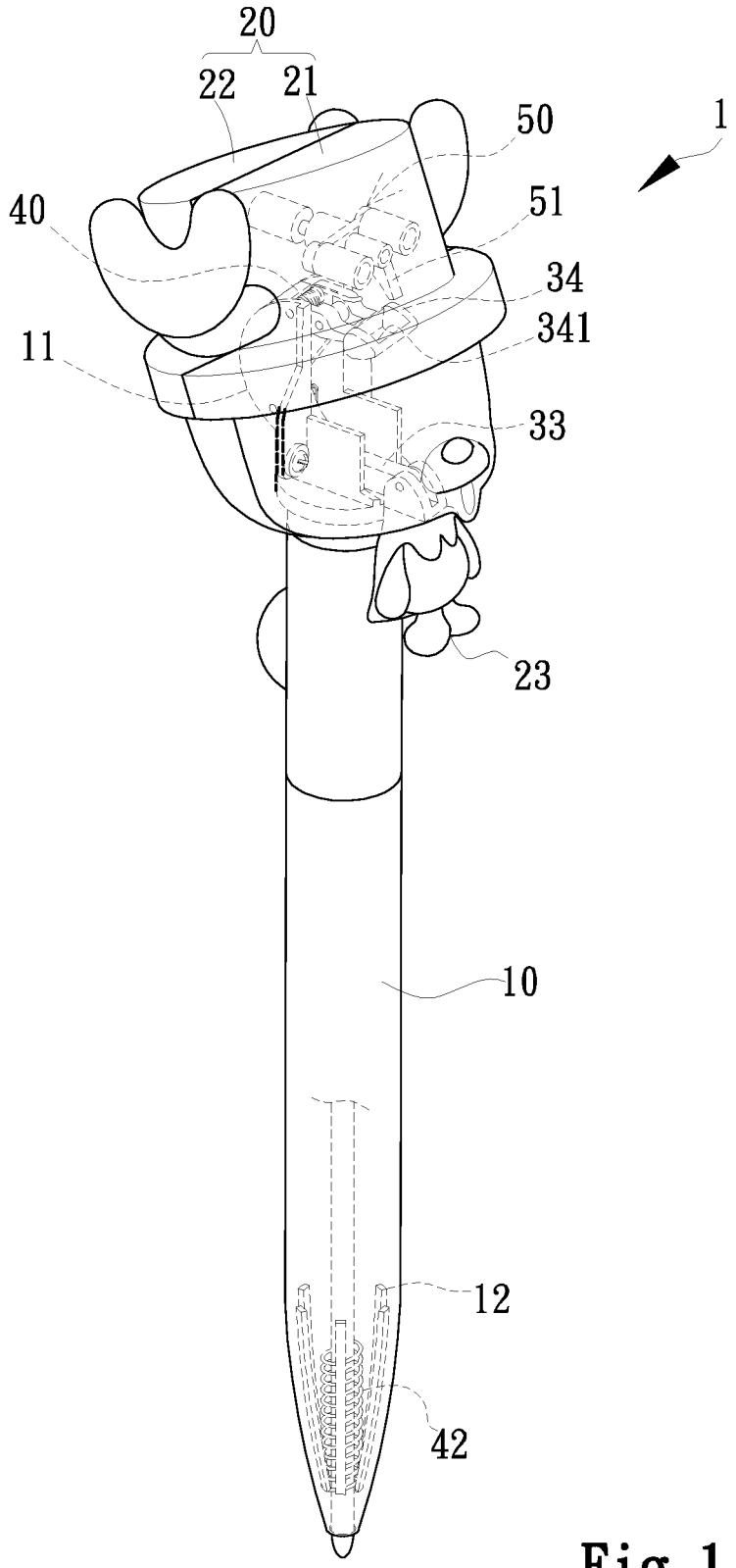
FIG. 1 is a perspective view of the first embodiment.

The preferred embodiments of the present invention are described in details hereinafter.

First Embodiment

Referring to FIGS. 1-7, a writing instrument (1) coupling with an ornament, comprises an elongated pen body (10) with a seat (11) mounted on an end thereof, an ornament (20) covers the seat (11), and a working piece (30) engages with said seat (11). Said working piece (30) consists essentially of a movable connecting rod (31), one side of said connecting rod (31) connects to a first driving element (32) which is pivotably joined to said seat (11), and moves upward and downward within said pen body (10), a second driving element (33) pivotably joints to said first driving element (32) and seat (11) respectively, a third driving element (34) pivotably jointed to said second driving element (33), a fourth driving element (35) pivotably jointed to said third driving element (34) and the seat (11) respectively, a first elastic element (40) is provided at where said fourth driving element (35) is jointed to the seat (11), a second elastic elements (41) and third elastic elements (42) are disposed in the top and bottom of the pen body (10) respectively. The function of said working piece (30) is as the fifth driven element 36 that is disclosed in U.S. Pat. No. 8,182,165, which is the present invention is matured from. The main body of the toy (20) is formed by a frontal and a rear casing (21, 22), and houses a decorating object (23) which is pivotably jointed to said second driving element (33). Said frontal casing (21) is pushed forward by the forth driving element (35) to form an opening for the extension of said decoration object (23) when the cartridge within the pen body (10) is propelled out for writing purpose.

The present invention is characterized in that said ornament (20) further incorporates with an extendable resilient device (50) for connecting said frontal and rear casings (21, 22). A butting member (51) is provided at a bottom portion of said resilient device (50) to be exerted by said fourth driving element (35) to lift the frontal casing (21). A hollow frame (351) is provided at a top of said fourth driving element for securing the position of said decoration object (23).

Figure 3:
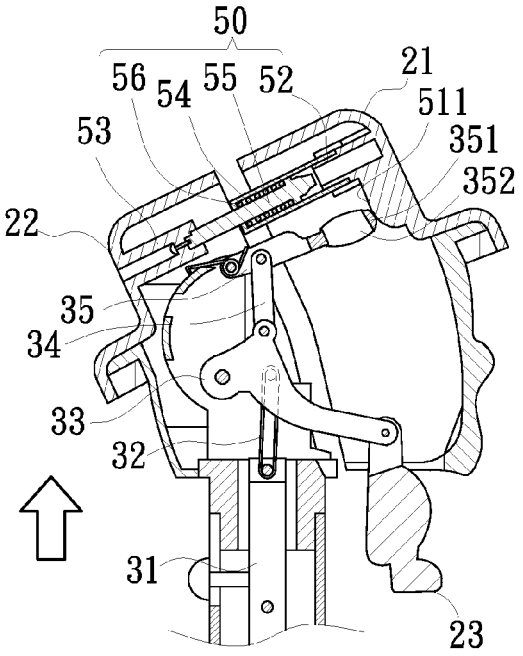
FIG. 3 is an enlarge view of FIG. 2 for demonstrating the details of mechanical components of the ornament.

Said frontal and rear casings (21, 22) are combined by said resilient device (50), wherein said frontal casing (21) is capable of being lifted to disengage from the rear casing (22) when said fourth driving element (35) is pushing against the butting member (51). As shown in FIG. 3, the frontal casing (21) is relatively larger than the rear casing (22), and said frontal and rear casings (21, 22) connect slantwise to ensure the mechanical elements in the ornament (20) function smoothly.

Figure 4:
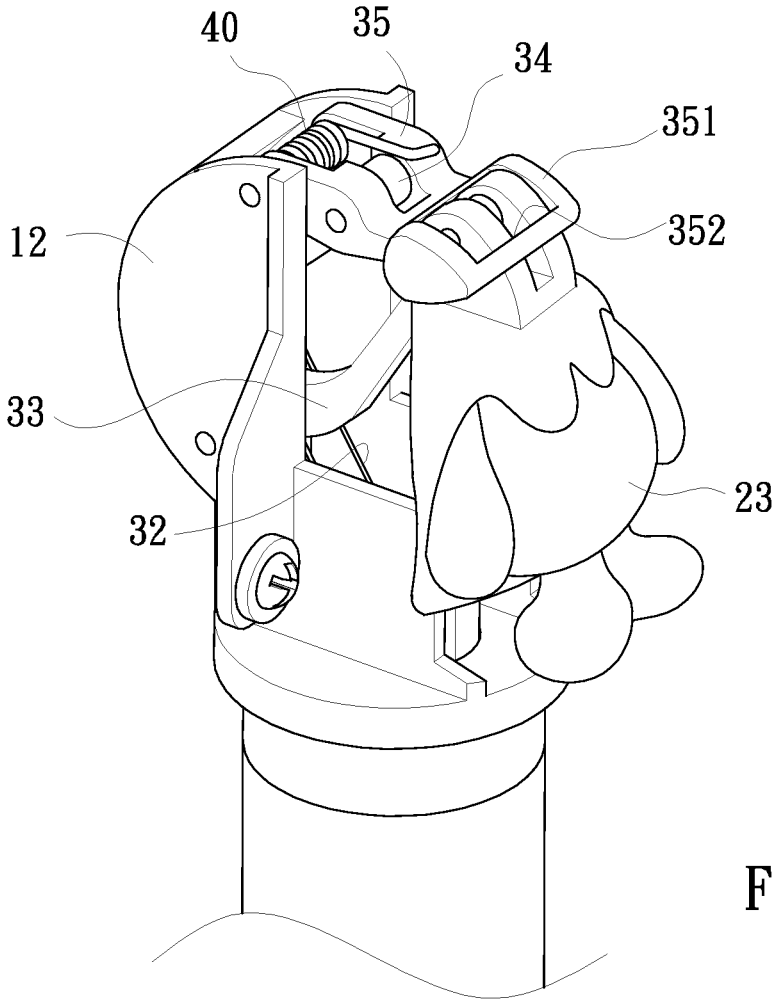
FIG. 4 is a schematic view of the mechanical structure of the present invention.

The decorating object (23) moves within the ornament (20) when the writing instrument (1) is utilized for writing purpose. Such swing movement may cause the decoration object (23) being jammed inside the ornament (20), thus, to secure the position of said decoration object (23), the upper portion of the object (23) engages with the frame (351). As shown in FIG. 4, the frame (351) comprises of a hollow portion (352) which corresponds to the shape of the decoration object (23). Therefore, the decoration object (23) stays securely inside said ornament (20).

Figure 2:
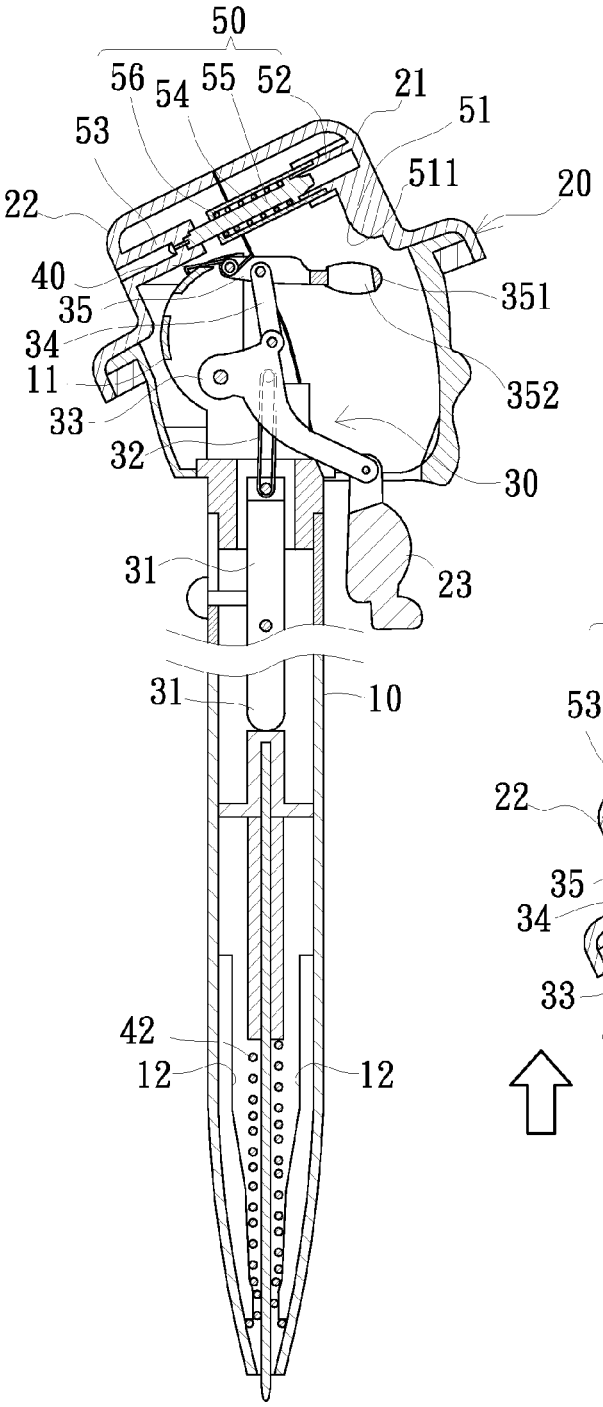
FIG. 2 is a cross sectional view of FIG. 1.
Figure 10:
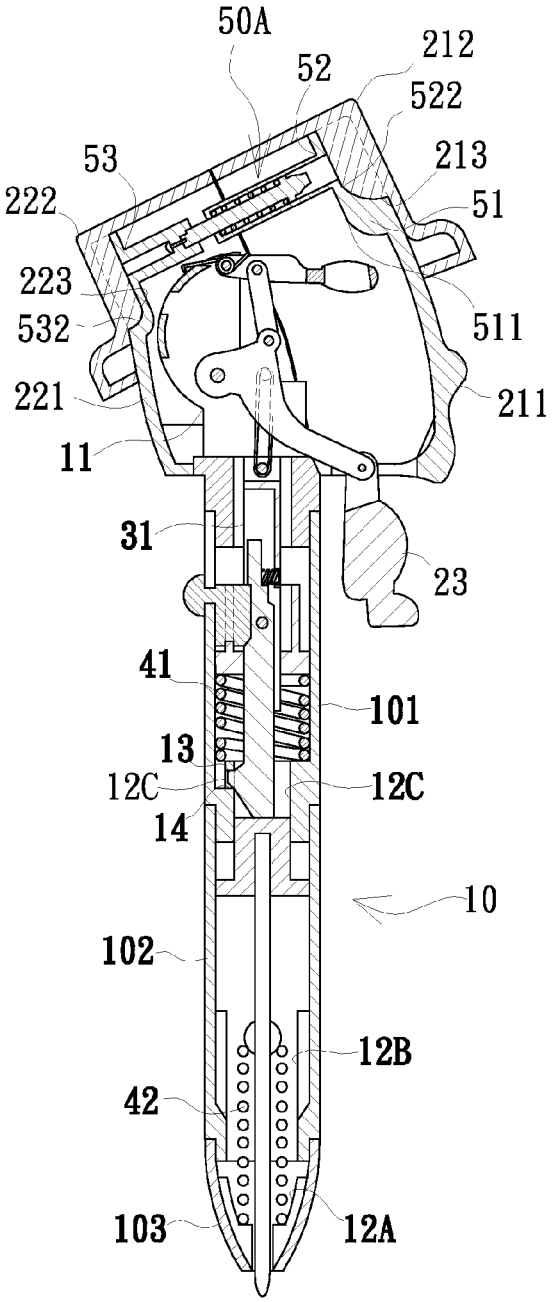
FIG. 10 is a cross sectional view of the second embodiment, illustrating the decorating object exposed.
Figure 11:
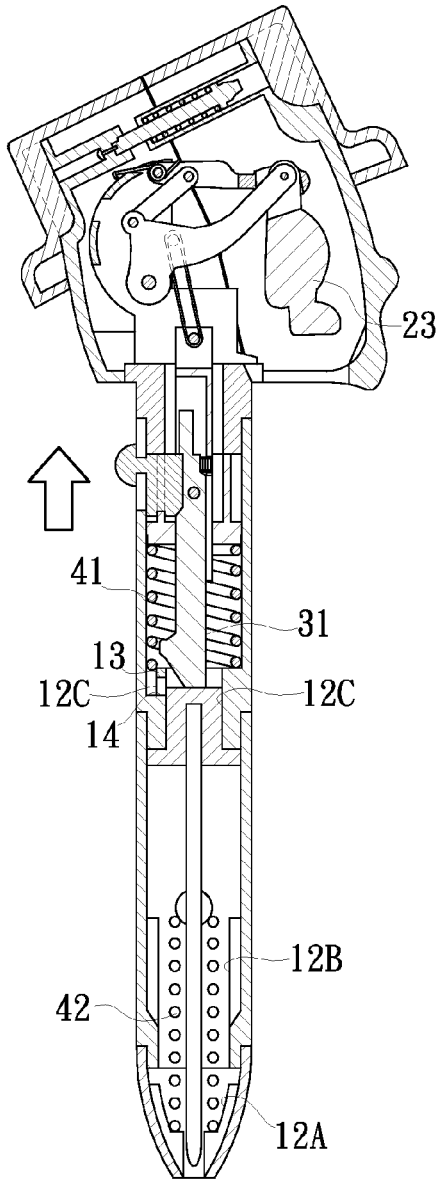
FIG. 11 is a cross sectional view of the first embodiment, illustrating the decorating object accommodated within.

Please refer FIG. 2, a slidable stud (not specified in Figs) is disposed outside the upper part of the pen body (10) which solidly connects to the connecting rod (31), a groove (not shown in Figs) for limiting the sliding range of said stud, and refer FIGS. 10 and 11, a cap is disposed inside the pen body (10) and against the bottom of said connecting rod (31), the inside of said cap is inserted by the cartridge, and a protruding tenon (not specified in Figs.) is protruding from the bottom of said connecting rod (31) to be jammed in the mortise (14).

When the stud slides down to the bottom of the groove, the connecting rod (31) is also moved down, and the second and third elastic element (41, 42) are both compressed, thus, the cap is also goes down to press the cartridge out of the hole on the bottom of said pen body (10), said tenon is jammed in said mortise (14) and stopped on the lower edge of said block (13) to keep the cartridge solidly positioned, and when the stud is slided to the top of said groove, the connecting rod (31) is also moved up, once said tenon is pulled out of said mortise (14), said second and third elastic element (41, 42) are released and recovered to original length, the cartridge is synchronously withdrawn into the pen body (10).

Figure 5:
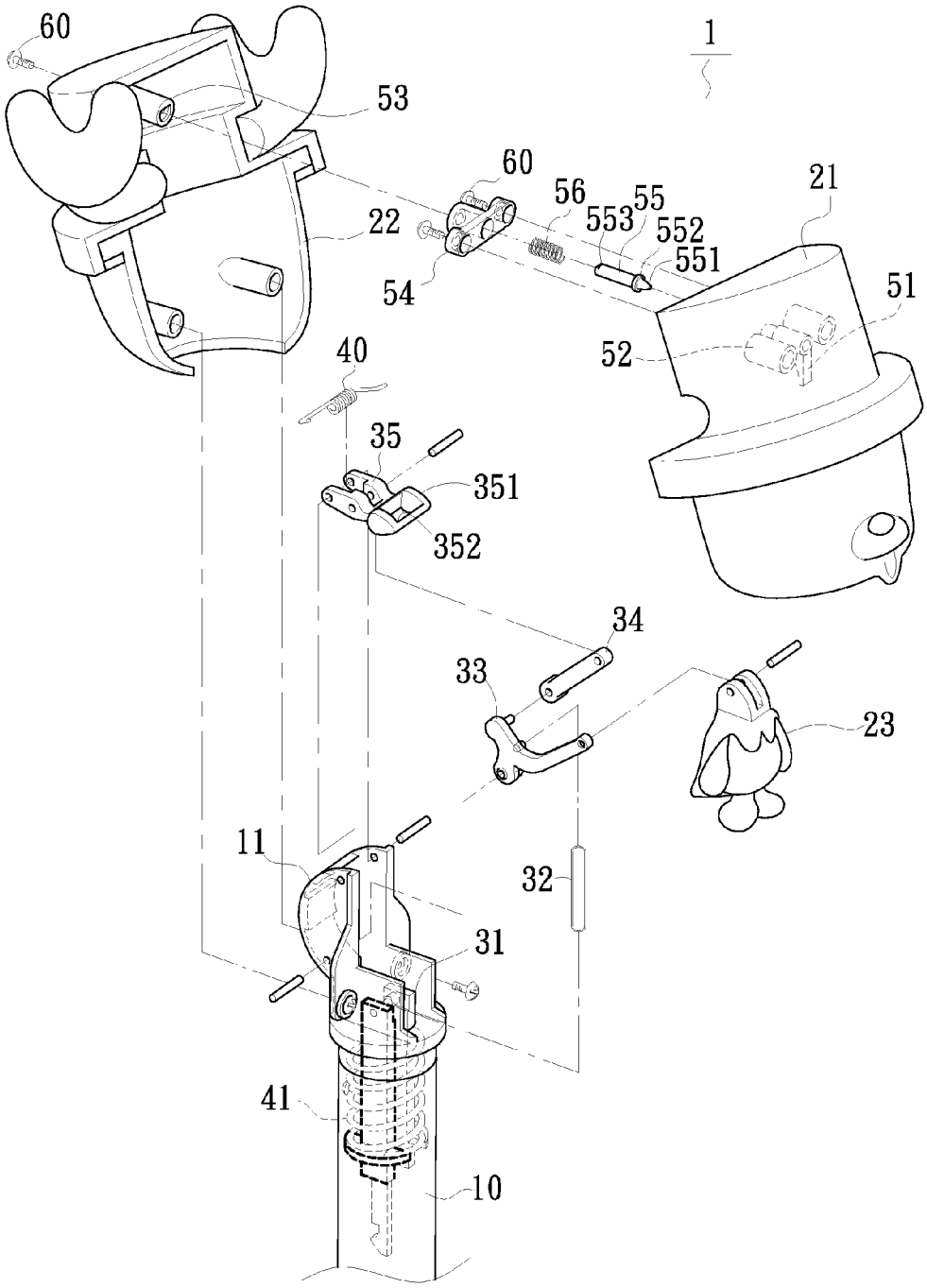
FIG. 5 is an exploded view of the first embodiment of the present invention.
Figure 6:
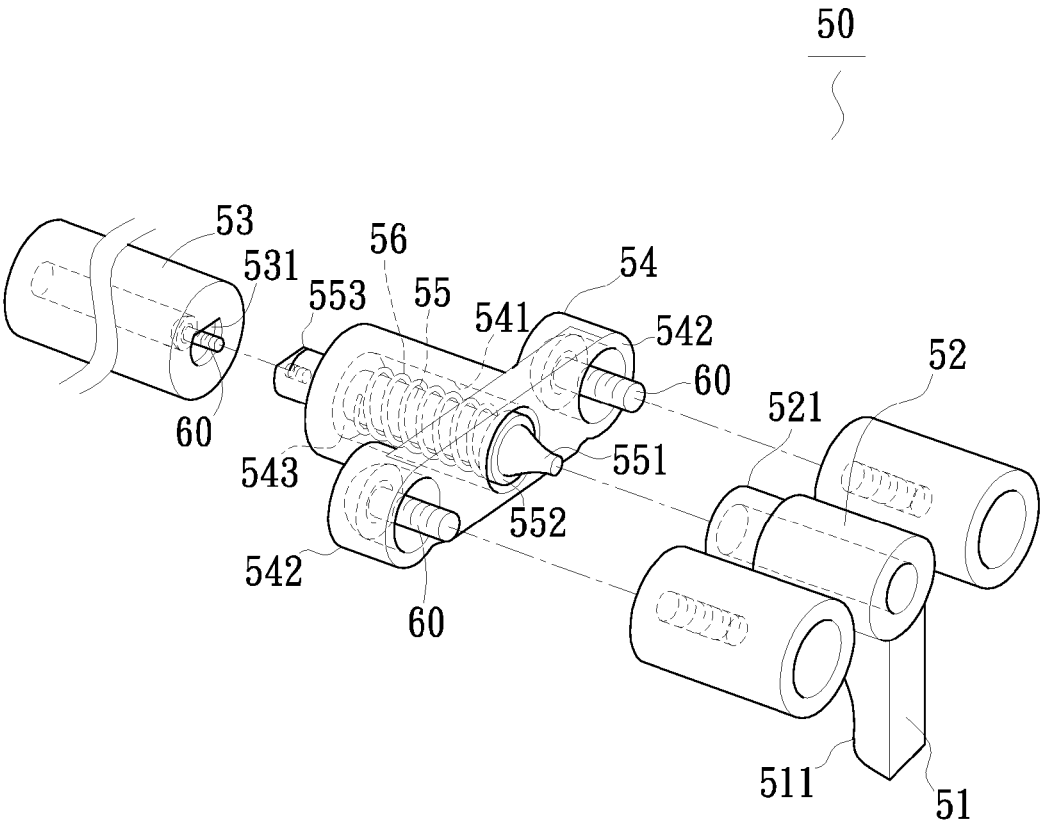
FIG. 6 is a perspective view of the resilient device of the present invention.

Refer FIGS. 2 and 3, the working piece (30) is connected with the connecting rod (30) by the first driving element (32), and the butting member (51), referring to FIGS. 5 and 6, includes a curved surface (511), the decorating object (23) is pulled down when the stud slides down to the bottom of the groove, because the second (33), third (34) and fourth (35) driving elements which are pivotably jointed to each other are driven respectively, one side of the hollow frame (351) which is pivotably jointed to the fourth driving (35) element is pulled down due to the leverage initialed by the movement of the stud and the connecting rod, which drives the mechanic of said working piece (30) to move, another side of said hollow frame (351) moves upward, and against said curved surface (511), to make the front (21) and rare (22) casing opening in a limited range which maintained by incorporating with the resilient device (50), in the same time, said decorating object (23) moves out of said front casing (21), until the cartridge completely come out of the pen body (10), and said part are all stopped in stable position, and said front (21) and rare (22) casing are closed, when stud slides up to the top of the groove, the decorating object (23) which connects to one end of said working piece (30) is also pulled up, the second (33), third (34) and fourth (35) driving elements which are pivotably jointed to each other are driven respectively, then one side of the hollow frame (351) which is pivotably jointed to the fourth driving (35) element is synchronously pulled up, and another side of said hollow frame (351) moves downward, that against the curved surface (511), to make the front (21) and rare (22) casing opening in a limited range which maintained by incorporating with the resilient device (50), in the same time, said decorating object (23) moves in of said front casing (21) and be restored in said hollow frame (351), until the cartridge is completely withdrawn into the pen body (10), and said part are all in stable position, and said front (21) and rare (22) casing are closed again. The shape of said butting member (51) can be selected from a block, a ridge or an arm according to the shape and structure of the frontal casing (21).

Figure 7:
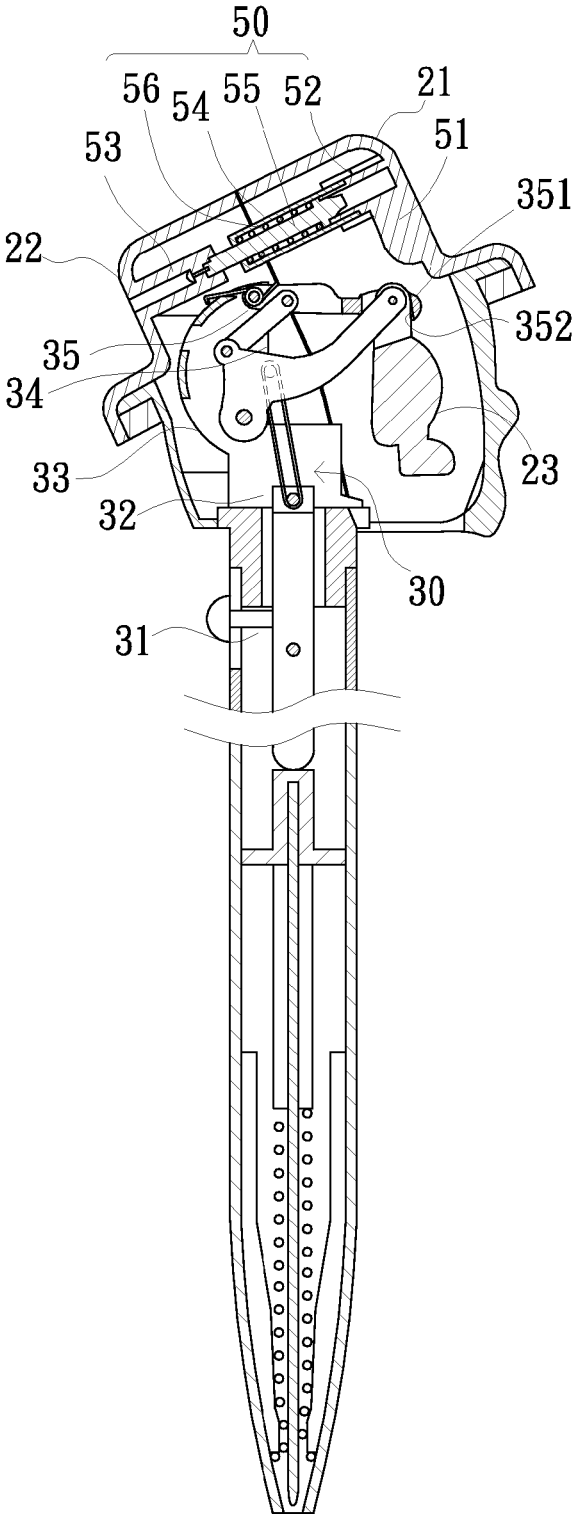
FIG. 7 is a cross sectional view of the first embodiment, illustrating the decorating object accommodated within.
Figure 8:
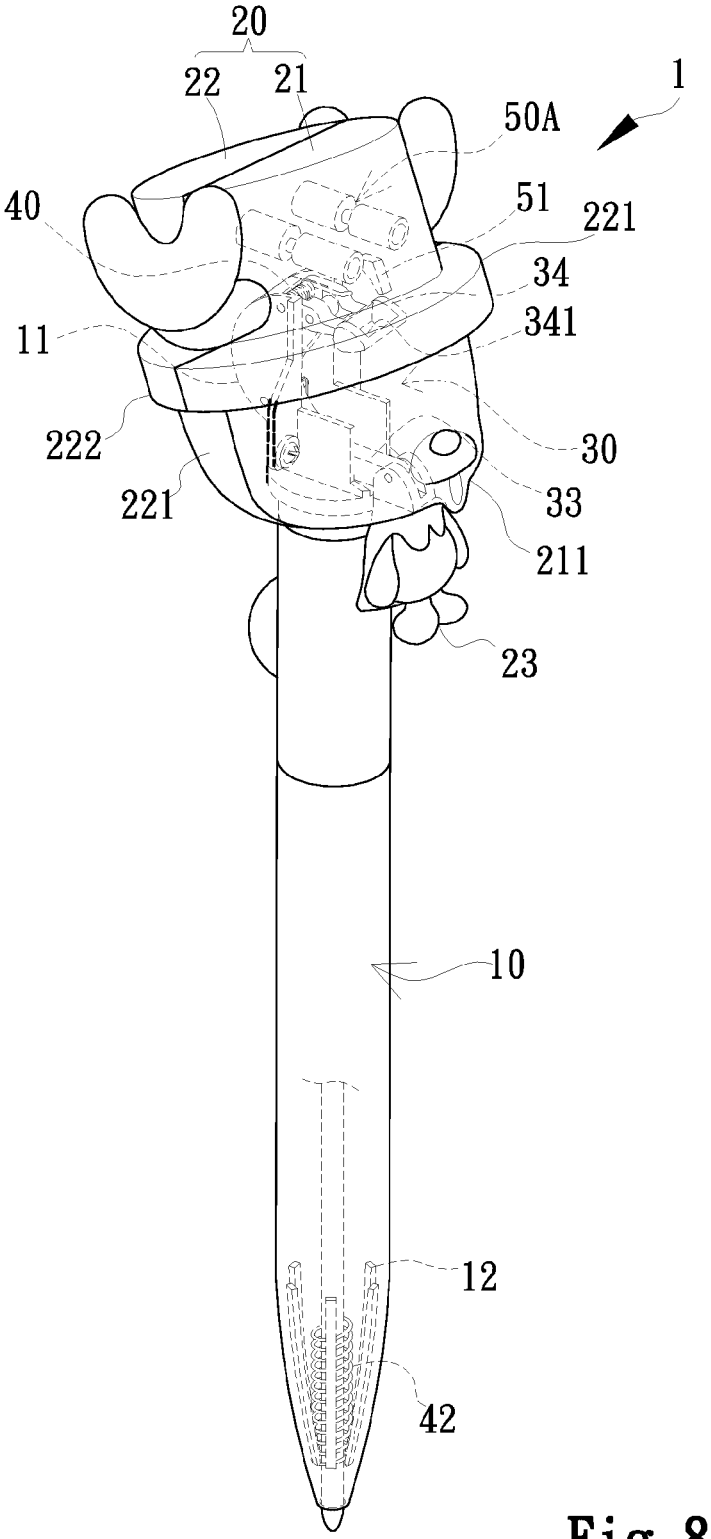
FIG. 8 is a perspective view of the second embodiment of the present invention.

Referring to FIGS. 5-7, the resilient device (50) consists of a first fastening element (52) provided at the inner wall of the frontal casing (21) and a second fastening element (53) provided at inner wall of the rear casing (22), a positioning element (54) attaches to said first fastening element (52), a rod (55) for engaging said positioning element (54) to said second fastening element (53), and a spring (56) sheathing said rod (55) for driving reciprocal movement. Said first fastening element (52) and positioning element (54), rod (55) and second fastening element (53) are coupled and fastened. The resilient device (50) provides elasticity and supports the frontal casing (21) as the working piece (30) is not actuated.

An end of said rod (55) is a cone-shape head (551) to engage with said first fastening element (52), and a stop ring (552) is provided on the head (551). A latch (553) is provided at another end of said rod (55) for attaching with said second fastening element (53). A backstop (521) which corresponds to said stop ring (552) is provided at an end of said first fastening element (52) and a groove (531) is provided at an end of said second fastening element (53) for receiving the latch (553). Said cone-shaped head (551) reduces the resistance when the rod (55) is sliding, stop ring (552) prevents the rod (55) from over going and latch (553) avoids the rotation of the rod (55).

A cylindrical compartment (541) is sized at a center portion of an end of said positioning element (54) for accommodating said rod (55) and spring (56), and two locating elements (542) are provided at both sides of said compartment (541) for the screws (60) to be screw fastened onto the first fastening element (52), and a stop ring (543) is provided at another end of said positioning element (54) for securing the spring (56). Both locating elements (542) align with said position element (54) which is screwed onto the first fastening element (52), and said stop ring (543) fixes one side of said the spring (56) to restore the position of the frontal casing (21) by elastic power when said frontal casing (21) disengages from the rear casing (22).

Several ribs (12) are provided longitudinally around the below of the inner wall of said pen body (10) for securing said third resilient device (42) to prevent disengagement as the pen body (10) being disassembled.

Second Embodiment

The second embodiment of the present invention is described and illustrated by referring to FIGS. 8-11. An ornament (20) incorporates an extendable resilient device (50A) for connecting a frontal and rear casings (21, 22) of the ornament, and a butting member (51) which is actuated by said fourth driving element (35) to move the frontal casing is provided at the bottom portion of said resilient device (50A). Hollow frame (351) is provided at a top of said fourth driving element (35) for receiving and securing an upper portion of the decorating object (23). Each of said frontal and rear casings (21, 22) is composed of an inner casing (211, 221) for engaging with said resilient device (50A), and an outer casing (212, 222) is covering on said inner casings (211, 221).

Said resilient device (50A) comprises of a first and second fastening elements (52, 53) disposed respectively at said frontal and rear inner casings (211, 221), two rods (55) for engaging said positioning element to said second fastening element, and two springs (56) sheathing the rods (55) respectively for driving reciprocal movement. a groove (522, 532) is provided respectively at said first and second fastening elements (52, 53), and a projected block (213, 223) which corresponds to said grooves (522, 532) is provided respectively at an inner wall of said frontal and rear outer casings (212, 222).

Figure 9:
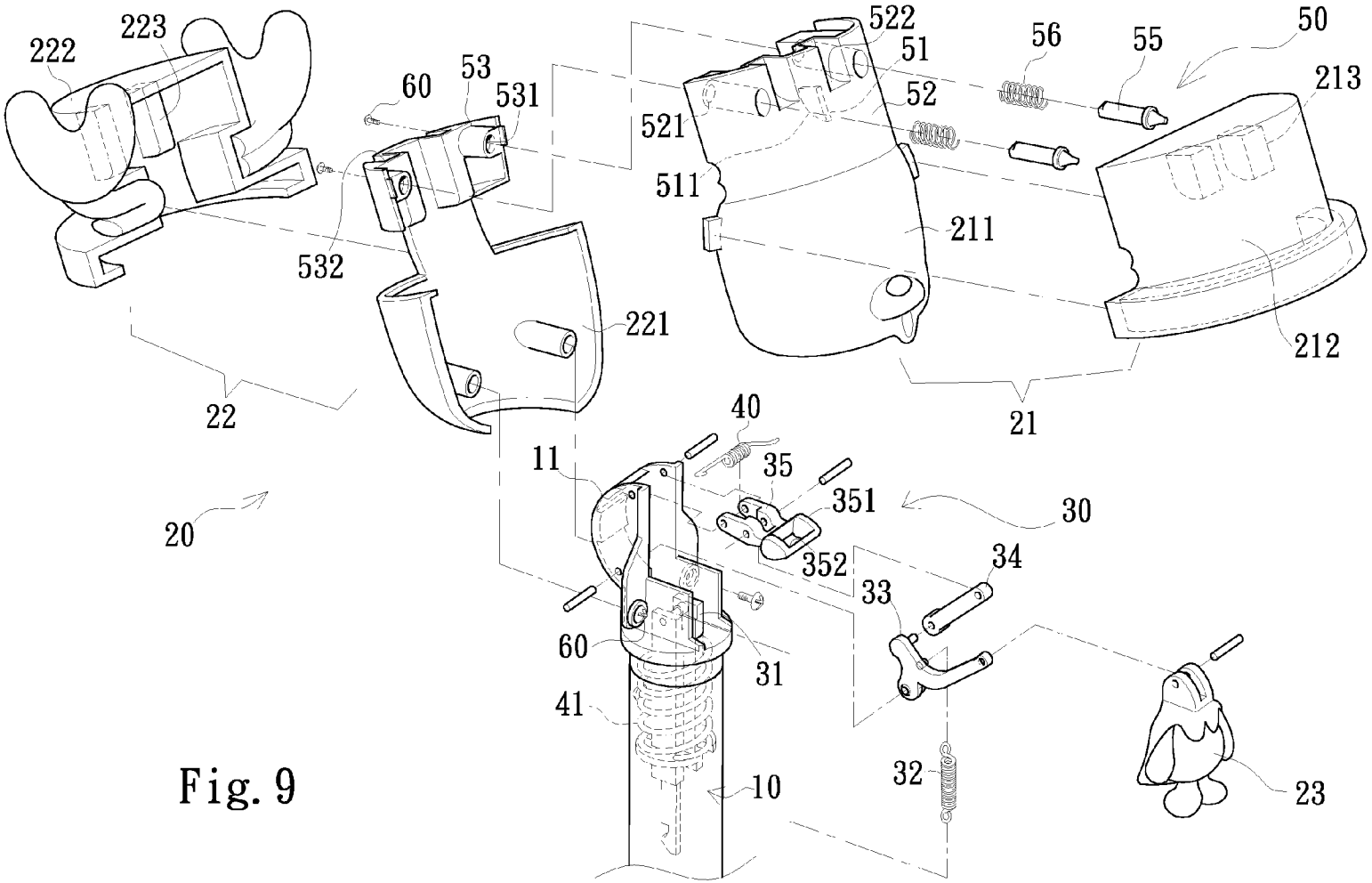
FIG. 9 is an exploded view of the second embodiment of the present invention.

In contrast with the monopiece frontal and rear casings (21 22) disclosed in the first embodiment, the frontal and rear casings (21, 22) of the second embodiment are composed of inner casings (211, 221) and outer casings (212, 222). As shown in FIG. 9, the ornament (20) is mounted on the pen body (10) by fastening the, rear inner casing (221) onto the seat (11) with screws (60). It facilitates the assembling and disassembling procedures of said ornament (20) as the first embodiment.

Assembling and disassembling of toy (20) with screws (60) and design of inner and outer casings provides more creativity and amusing factor to the toy (20) of the second embodiment as the outer casing (212, 222) can be replaced by other variations to avoid user being bored with monotonic design.

The rod (55) of the resilient device (50A) has the same shape as disclosed in the first embodiment and is disposed at the left and right side of the inner side of the toy (20). Each front end of said rods (55) passes through the frontal inner casing (211) and the rear end thereof is guided into a locating hole (531) of the second fastening element (53) then be fastened thereon with screws (60).

Said resilient device (50A) in second embodiment is relatively stronger in structural strength and the dual springs design provided better recovery elasticity, also extend the durability against metal exhaust.

The pen body (10) of the second embodiment, referring to FIGS. 10 and 11, consists of an upper tubular portion (101) incorporating the connecting rod (31) and the third elastic element (42), a lower tubular portion (102) whose an end engages the upper tubular portion (101) incorporates a cartridge and a cap (103) mounted to another end of the portion (102). The seat (11) is later mounted onto the top of the upper tubular portion (101).

Several first ribs (12A) and second ribs (12B) are provided at the bottom of the inner wall of said pen body (10) for securing the third elastic element (42), Several third ribs (12C) are further provided in the connection part of the upper part and lower part of said pen body (10) for securing the second elastic element (41). A block (13) is provided between each pair of said third ribs (12C), and a mortise (14) is sized below said block for engaging with the protruding tenon of said connecting rod (31). Said third ribs (12C) are provided at the inner bottom of said upper tubular portion (101) to prevent disengagement of said second elastic element (41). The second ribs (12B) are disposed at the inner bottom of said lower tubular portion (102) and the first ribs (12A) are provided at the inner wall of the cap (103) to prevent the disengagement of said third elastic element (42).

The invention claimed is:

1. A writing instrument with a movable ornament mounted thereon, comprises of an elongated pen body with a seat mounted on an end thereof, an ornament covers said seat, a working piece is provided inside said ornament and engaging with said seat to drive the ornament; said working piece consists essentially of a movable connecting rod which is disposed in said pen body, a first driving element is disposed in said ornament and connected to said connecting rod, a second driving element is pivotably jointed to said first driving element and seat respectively, a third driving element is pivotably jointed to said second driving element, a fourth driving element is pivotably jointed to said third driving element and the seat respectively, a first elastic element is provided at where said fourth driving element is pivotably jointed to the seat, and at least one second elastic element is disposed in the pen body and surrounding said first driving element;

Said ornament is characterized in that:

The ornament is assembled by a frontal and rear casing, and consists of a decorating object which is pivotably jointed to said second driving element;

Said rear casing is screw fixed on said seat;

An extendable resilient device is provided inside said ornament for fixing the frontal casing to the rear casing, which is characterized in that:

A butting member which is exerted by said fourth driving element for lifting the frontal casing is disposed below said resilient device; a hollow frame is set in the front of said fourth driving element for restoring the decorating object.

2. A writing instrument with a movable ornament mounted thereon described in claim 1, wherein said butting member includes a curved surface.

3. A writing instrument with a movable ornament mounted thereon described in claim 1, wherein said butting member is a projected block, rib or column which is connected on an inner wall of said frontal casing.

4. A writing instrument with a movable ornament mounted thereon described in claim 1, wherein said resilient device further comprises a first and second fastening elements disposed respectively at said frontal and rear casings, a demountable positioning element is attached to said first fastening element, a rod for engaging said positioning element to said second fastening element, and a spring sheathing said rod for proving reciprocal movement.

5. A writing instrument with a movable ornament mounted thereon described in claim 4, wherein an end of said rod has a coned head which engages with said first fastening element, a stop ring is provided under said coned part, a pillar with a screw hole on the bottom, is provided at another end of said rod for connecting with said second fastening element; a backstop which corresponds to said stop ring is provided at an end of said first fastening element, and a groove is provided at an end of said second fastening element for storing said pillar.

6. A writing instrument with a movable ornament mounted thereon described in claim 4, wherein the center portion of an end of said positioning element has a compartment for accommodating said rod and spring, and two locating elements are provided on both sides of said compartment to screw fastening said first fastening element, and a stop ring is provided at another end of said positioning element for securing the spring.

7. A writing instrument with a movable ornament mounted thereon described in claim 1, wherein said pen body has several longitudinal ribs which are disposed in the bottom and encircled in the inner wall of said pen body for securing the third resilient elements.

8. A writing instrument with a movable ornament mounted thereon, comprises of an elongated pen body with a seat mounted on an end thereof, an ornament covers said seat, and a working piece engages to said seat to drive said ornament; said working piece consists essentially of a movable connecting rod which attaches to the seat and moves upward and downward within said pen body, a first driving element incorporated in the toy and is driven by the connecting rod, a second driving element pivotably jointed to first driving element and seat respectively, a third driving element pivotably jointed to said second driving element, a fourth driving element pivotably jointed to said third driving element and the seat respectively, a first elastic element provided at where said fourth driving element jointed the seat, and at least one second elastic element incorporated in the pen body for driving elements provided therein to move reciprocally; the ornament includes and incorporates a decoration device which is pivotably jointed to said first and second driving elements, is characterized in that:

said ornament further incorporates a resilient device for connecting the frontal and rear casings of said ornament; a butting member which is exerted by said fourth driving element to lift the frontal casing is provided at a bottom portion of said resilient device; a hollow frame is provided at a top of said fourth driving element for receiving the decoration; said frontal and rear casings further include two inner casings for engaging with said resilient device, and two outer casings sheathing said inner casings.

9. A writing instrument with a movable ornament mounted thereon described in claim 8, wherein said resilient device comprises of a first and second fastening elements disposed respectively at said frontal and rear casings, two rods for engaging said positioning element to said second fastening element, and two springs sheathing said rods respectively for proving reciprocal movement; a groove is provided respectively at said first and second fastening elements, and a projected block which corresponds to said groove is provided respectively at an inner wall of said outer casings.

10. A writing instrument with a movable ornament mounted thereon described in claim 8, wherein several first and second ribs are provided at an inner wall of said pen body for securing the second and third resilient device, a plurality of third ribs are further provided for securing another second resilient device; each pair of said third ribs are connected by a jammer, and a mortise is sized at a bottom thereof for engaging the tenon protruding from said connecting rod.

* * * * *